US009682418B1

(12) United States Patent
Young et al.

(10) Patent No.: US 9,682,418 B1
(45) Date of Patent: Jun. 20, 2017

(54) METHOD AND APPARATUS FOR INCREMENTAL SHEET FORMING

(75) Inventors: Keith A. Young, St. Peters, MO (US); Richard J. Lederich, Des Peres, MO (US); James B. Castle, St. Charles, MO (US); Christopher S. Huskamp, St. Louis, MO (US)

(73) Assignee: THE BOEING COMPANY, Chicago, IL (US)

( * ) Notice: Subject to any disclaimer, the term of this patent is extended or adjusted under 35 U.S.C. 154(b) by 1957 days.

(21) Appl. No.: 12/486,960

(22) Filed: Jun. 18, 2009

(51) Int. Cl.
*B21J 5/00* (2006.01)
*B21J 3/00* (2006.01)

(52) U.S. Cl.
CPC *B21J 5/008* (2013.01); *B21J 3/00* (2013.01)

(58) Field of Classification Search
USPC ..... 72/75, 41, 43–45; 184/6.21, 65, 7.1, 8, 184/48.2
See application file for complete search history.

(56) References Cited

U.S. PATENT DOCUMENTS

| | | | | |
|---|---|---|---|---|
| 3,201,967 | A | 8/1965 | Balamuth et al. | |
| 3,516,274 | A | 6/1970 | Graham et al. | |
| 3,643,483 | A | 2/1972 | Minchenko et al. | |
| 4,071,097 | A | 1/1978 | Fulop et al. | |
| 4,129,027 | A | 12/1978 | Ignashev et al. | |
| 4,828,052 | A | 5/1989 | Duran et al. | |
| 4,947,668 | A * | 8/1990 | Ostertag | 72/75 |
| 5,419,791 | A | 5/1995 | Folmer | |
| 5,771,729 | A | 6/1998 | Bailey et al. | |
| 6,216,508 | B1 | 4/2001 | Matsubara et al. | |
| 6,532,786 | B1 | 3/2003 | Luttgeharm | |
| 6,561,002 | B2 | 5/2003 | Okada et al. | |
| 6,622,570 | B1 | 9/2003 | Prevey, III | |
| 6,736,729 | B2 * | 5/2004 | Wang et al. | 29/898.1 |
| 6,745,609 | B2 | 6/2004 | Garnett et al. | |
| 6,748,780 | B1 | 6/2004 | Luttgeharm | |
| 6,755,064 | B2 | 6/2004 | Butscher et al. | |
| 6,764,057 | B2 | 7/2004 | Fanucci et al. | |
| 6,779,708 | B2 | 8/2004 | Slattery | |
| 6,823,705 | B2 | 11/2004 | Fukuda et al. | |
| 6,910,616 | B2 | 6/2005 | Halley et al. | |
| 6,971,256 | B2 | 12/2005 | Okada et al. | |
| 7,066,375 | B2 | 6/2006 | Bolser | |
| 7,079,996 | B2 | 7/2006 | Stewart et al. | |

(Continued)

FOREIGN PATENT DOCUMENTS

WO 2005049298 A1 6/2005

OTHER PUBLICATIONS

U.S. Appl. No. 12/486,968, filed Jun. 18, 2009, Huskamp et al.

(Continued)

*Primary Examiner* — David Bryant
*Assistant Examiner* — Pradeep C Battula
(74) *Attorney, Agent, or Firm* — Yee & Associates, P.C.

(57) ABSTRACT

A method and apparatus for processing a sheet of material. The sheet of material may be secured relative to a tool in an incremental sheet metal forming machine. The sheet of material may be incrementally shaped into a shape of a part using a stylus. The stylus may comprise a rod having a first end and a second end, a substantially curved surface on the first end, and a texture on at least a portion of the substantially curved surface on the first end. The texture may be configured to channel a lubricant onto the first end.

19 Claims, 7 Drawing Sheets

(56) References Cited

U.S. PATENT DOCUMENTS

| | | | |
|---|---|---|---|
| 7,083,076 | B2 | 8/2006 | Slattery |
| 7,128,948 | B2 | 10/2006 | Slattery |
| 7,156,276 | B2 | 1/2007 | Slattery |
| 7,225,967 | B2 | 6/2007 | Slattery |
| 7,243,517 | B2 | 7/2007 | Sieger |
| 7,302,831 | B2 | 12/2007 | Moyse et al. |
| 7,347,351 | B2 | 3/2008 | Slattery |
| 7,353,978 | B2 | 4/2008 | Slattery et al. |
| 7,381,446 | B2 | 6/2008 | Slattery |
| 7,398,911 | B2 | 7/2008 | Slattery et al. |
| 7,431,194 | B2 | 10/2008 | Slattery |
| 7,479,201 | B1 | 1/2009 | Wegner et al. |
| 7,509,725 | B2 | 3/2009 | Huskamp et al. |
| 7,515,986 | B2 | 4/2009 | Huskamp |
| 7,536,892 | B2 | 5/2009 | Amino et al. |
| 7,607,225 | B2 | 10/2009 | Huskamp et al. |
| 7,669,750 | B2 | 3/2010 | Slattery et al. |
| 7,841,504 | B2 | 11/2010 | Slattery et al. |
| 7,854,363 | B2 | 12/2010 | Slattery et al. |
| 8,033,151 | B2 | 10/2011 | Castle et al. |
| 8,177,113 | B2 | 5/2012 | Slattery |
| 2002/0088549 | A1 | 7/2002 | Fanucci et al. |
| 2003/0154757 | A1 | 8/2003 | Fukuda et al. |
| 2003/0168494 | A1 | 9/2003 | Halley et al. |
| 2004/0004108 | A1 | 1/2004 | Halley et al. |
| 2004/0112941 | A1 | 6/2004 | Slattery |
| 2004/0148997 | A1 | 8/2004 | Amino et al. |
| 2005/0084701 | A1 | 4/2005 | Slattery |
| 2005/0127139 | A1 | 6/2005 | Slattery et al. |
| 2005/0127140 | A1 | 6/2005 | Slattery |
| 2006/0016854 | A1 | 1/2006 | Slattery |
| 2006/0037992 | A1 | 2/2006 | Slattery |
| 2006/0059848 | A1 | 3/2006 | MacDonald-Schmidt et al. |
| 2006/0060635 | A1 | 3/2006 | Slattery et al. |
| 2006/0150710 | A1 | 7/2006 | Moyse et al. |
| 2006/0236544 | A1 | 10/2006 | Huskamp et al. |
| 2006/0272378 | A1 | 12/2006 | Amino et al. |
| 2007/0014983 | A1 | 1/2007 | Slattery |
| 2007/0050979 | A1 | 3/2007 | Huskamp et al. |
| 2007/0075121 | A1 | 4/2007 | Slattery |
| 2007/0186507 | A1 | 8/2007 | Slattery |
| 2008/0262659 | A1 | 10/2008 | Huskamp |
| 2008/0276566 | A1 | 11/2008 | Slattery et al. |
| 2008/0277451 | A1 | 11/2008 | Slattery et al. |
| 2009/0250834 | A1 | 10/2009 | Huskamp et al. |
| 2010/0257909 | A1 | 10/2010 | Huskamp et al. |
| 2010/0257910 | A1 | 10/2010 | Castle et al. |
| 2011/0036139 | A1 | 2/2011 | Slattery |

OTHER PUBLICATIONS

USPTO office action for U.S. Appl. No. 12/420,399 dated Apr. 6, 2011.

USPTO office action for U.S. Appl. No. 12/062,994 dated Feb. 24, 2011.

Lamminen et al., "Incremental Sheet Forming with an Industrial Robot", Materials Forum vol. 29, 2005, Institute of Materials Engineering Australasia Ltd, pp. 331-335.

Pohlak et al., "Manufacturability and limitations in incremental sheet forming", Proc. Estonian Acad. Sci. Eng., 2007, pp. 129-139.

U.S. Appl. No. 12/062,994, filed Apr. 4, 2008, Huskamp et al.

U.S. Appl. No. 12/420,433, filed Apr. 8, 2009, Huskamp et al.

U.S. Appl. No. 12/420,399, filed Apr. 8, 2009, Castle et al.

USPTO Final Office Action, dated Feb. 24, 2011, regarding U.S. Appl. No. 12/062,994, 9 pages.

USPTO Office Action, dated Apr. 6, 2012, regarding U.S. Appl. No. 12/420,433, 25 pages.

USPTO Notice of Allowance, dated Jun. 21, 2011, regarding U.S. Appl. No. 12/420,399, 8 pages.

USPTO Office Action, dated Dec. 21, 2011, regarding U.S. Appl. No. 12/540,301, 11 pages.

USPTO Notice of Allowance dated Jun. 1, 2012 regarding U.S. Appl. No. 12/540,301, 8 Pages.

Final Office Action issued on Sep. 24, 2012 for U.S. Appl. No. 12/420,433, 23 pages.

Notice of Allowance issued on Jul. 20, 2012 for U.S. Appl. No. 12/540,301, 13 pages.

Office Action issued on Jul. 3, 2012 for U.S. Appl. No. 12/486,968, 34 pages.

Office Action, dated Apr. 5, 2013, regarding U.S. Appl. No. 12/486,968, 18 pages.

Final Office Action issued on Dec. 10, 2012 for U.S. Appl. No. 12/486,968, 18 pages.

Office Action, dated Sep. 5, 2013, regarding U.S. Appl. No. 12/486,968, 21 pages.

Notice of allowance dated Jun. 25, 2013 regarding U.S. Appl. No. 12/420,433, 2 pages.

* cited by examiner

METHOD AND APPARATUS FOR INCREMENTAL SHEET FORMING

CROSS REFERENCE TO RELATED APPLICATION

The present disclosure is related to the following patent application: entitled "Method and Apparatus for Incremental Sheet Forming", Ser. No. 12/486,968, filed even date hereof, assigned to the same assignee, and incorporated herein by reference.

BACKGROUND INFORMATION

1. Field

The present disclosure relates generally to manufacturing and, in particular, to manufacturing parts. Still more particularly, the present disclosure relates to increasing lubrication of the interface of a tool and a sheet of material during incremental sheet forming.

2. Background

Oftentimes, aircraft parts may be manufactured in limited runs or numbers. For example, one or two parts may be created as a prototype for testing. As another example, a small number of parts may be manufactured for an aircraft that is no longer in production. With these types of parts, incremental sheet metal forming may be used to manufacture aircraft parts. Incremental sheet metal forming may be used to manufacture parts more cheaply and/or quickly than other techniques.

For example, without limitation, with incremental sheet metal forming, a part may be manufactured in a manner to reduce tooling costs. Further, incremental sheet metal forming may be useful when parts may be needed only in limited numbers and/or for prototype testing.

In manufacturing parts, incremental sheet metal forming may be used to create a shape for a part from a sheet of material. Incremental sheet metal forming may be used with sheet metal to form a part. For example, sheet metal may be formed using a round-tipped tool, stylus, and/or some other suitable type of tool.

This tool may be attached to a computer numerical control machine, a robot arm, and/or some other suitable system to shape the sheet metal into the desired shape for the part. The tool may make indentations, creases, and/or other physical changes or inconsistencies into the sheet metal that may follow a contour for the desired part. This contour may be defined using a tool on which the stylus presses the sheet metal material.

Further, incremental sheet metal forming may be used to produce complex shapes from various materials. This type of process may provide easy part modification. For example, a part may be modified by changing the model of the part without requiring retooling or new dies.

Incremental sheet metal forming may be performed on a number of different types of sheet metal materials. For example, without limitation, incremental sheet metal forming may be performed on aluminum, steel, titanium, and/or other suitable metals.

When a stylus contacts the surface of a sheet of material, such as sheet metal, the sheet metal material may deform in an undesirable manner. This deformation may be caused by the amount of force and/or composition of the sheet metal material.

One solution may involve using a stylus that is capable of rotating. Although this solution may reduce the friction between the stylus and the sheet metal material, some undesirable changes may still occur. As a result, careful selection of sheet materials for use in incremental sheet metal forming may be required.

Therefore, it would be advantageous to have a method and apparatus that takes into account at least some of the issues discussed above, as well as possibly other issues.

SUMMARY

In one advantageous embodiment, an apparatus may comprise a rod, a substantially curved surface, and a texture. The rod may have a first end and a second end. The substantially curved surface may be on the first end. The texture may be on at least a portion of the substantially curved surface on the first end. The texture may be configured to channel a lubricant onto the first end.

In another advantageous embodiment, an incremental sheet forming apparatus for forming aircraft parts may comprise a stylus, a platform, a motion control system, and a lubrication system. The stylus may comprise a rod having a first end and a second end, a ball associated with the first end, a substantially curved surface on the ball, a texture on at least a portion of the substantially curved surface on the first end, and a channel extending through the rod to the first end. The channel may be configured to cause a lubricant to flow through the rod to the ball at the first end and onto the substantially curved surface on the ball. The texture may be configured to channel the lubricant onto the ball and maintain the lubricant on the ball, in which the texture is selected from at least one of grooves, dimples, and holes. The platform may be configured to hold a sheet metal material. The motion control system may be configured to control movement of the stylus to impinge the sheet metal material to form an aircraft part. The lubrication system may be configured to supply the lubricant to the substantially curved surface, while the stylus impinges the sheet metal material. The lubrication system may be configured to supply the lubricant to the substantially curved surface while the stylus impinges the sheet metal material through at least one of sending the lubricant down a surface of the rod, through a channel in the rod to a number of holes in the substantially curved surface, and to a location on a surface of the sheet metal material prior to the stylus impinging the location. The lubrication on the substantially curved surface may reduce undesired deformation of the sheet metal material, while the stylus impinges the sheet metal material.

In yet another advantageous embodiment, a method may be present for processing a sheet of material. The sheet of material may be secured relative to a tool in an incremental sheet metal forming machine. The sheet of material may be incrementally shaped into a shape of a part using a stylus. The stylus may comprise a rod having a first end and a second end, a substantially curved surface on the first end, and a texture on at least a portion of the substantially curved surface on the first end. The texture may be configured to channel a lubricant onto the first end.

In still yet another advantageous embodiment, a method may be present for manufacturing a part for an aircraft. A sheet metal material may be secured relative to a tool in an incremental sheet metal forming machine. The sheet metal material may be incrementally shaped into a shape of the part by impinging the sheet metal material with a stylus. The stylus may comprise a rod having a first end and a second end, a ball associated with the first end, a substantially curved surface on the ball, a texture on at least a portion of the substantially curved surface on the first end, and a channel extending through the rod to the first end. The channel may be configured to cause a lubricant to flow through the rod to the ball at the first end and onto the substantially curved surface on the ball. The texture may be configured to channel the lubricant onto the ball and maintain the lubricant on the ball, in which the texture may be selected from at least one of grooves, dimples, pits, and holes. The lubricant may be supplied to the substantially curved surface, while the stylus impinges the sheet metal material through at least one of sending the lubricant down a surface of the rod, through the channel in the rod to a number of holes in the substantially curved surface, and to a location on a surface of the sheet metal material prior to the stylus impinging the location.

The features, functions, and advantages can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the advantageous embodiments are set forth in the appended claims. The advantageous embodiments, however, as well as a preferred mode of use, further objectives, and advantages thereof, will best be understood by reference to the following detailed description of an advantageous embodiment of the present disclosure when read in conjunction with the accompanying drawings, wherein:

DETAILED DESCRIPTION

Figure 1:
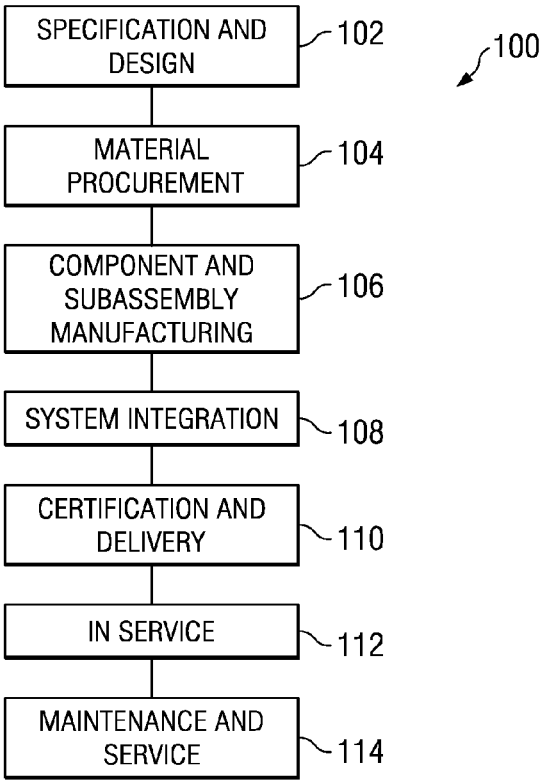
FIG. 1 is an illustration of an aircraft manufacturing and service method in accordance with an advantageous embodiment.
Figure 2:
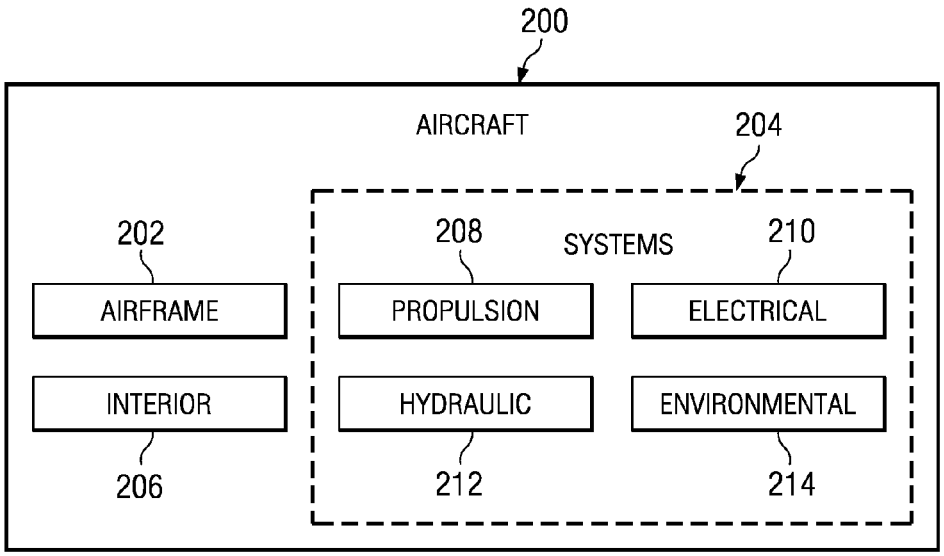
FIG. 2 is an illustration of an aircraft in which an advantageous embodiment may be implemented.

Referring more particularly to the drawings, embodiments of the disclosure may be described in the context of aircraft manufacturing and service method 100 as shown in FIG. 1 and aircraft 200 as shown in FIG. 2. Turning first to FIG. 1, an illustration of an aircraft manufacturing and service method is depicted in accordance with an advantageous embodiment. During pre-production, aircraft manufacturing and service method 100 may include specification and design 102 of aircraft 200 in FIG. 2 and material procurement 104.

During production, component and subassembly manufacturing 106 and system integration 108 of aircraft 200 in FIG. 2 takes place. Thereafter, aircraft 200 in FIG. 2 may go through certification and delivery 110 in order to be placed in service 112. While in service by a customer, aircraft 200 in FIG. 2 is scheduled for routine maintenance and service 114, which may include modification, reconfiguration, refurbishment, and other maintenance or service.

Each of the processes of aircraft manufacturing and service method 100 may be performed or carried out by a system integrator, a third party, and/or an operator. In these examples, the operator may be a customer. For the purposes of this description, a system integrator may include, without limitation, any number of aircraft manufacturers and major-system subcontractors; a third party may include, without limitation, any number of venders, subcontractors, and suppliers; and an operator may be an airline, leasing company, military entity, service organization, and so on.

With reference now to FIG. 2, an illustration of an aircraft is depicted in which an advantageous embodiment may be implemented. In this example, aircraft 200 is produced by aircraft manufacturing and service method 100 in FIG. 1 and may include airframe 202 with a plurality of systems 204 and interior 206. Examples of systems 204 include one or more of propulsion system 208, electrical system 210, hydraulic system 212, and environmental system 214. Any number of other systems may be included. Although an aerospace example is shown, different advantageous embodiments may be applied to other industries, such as the automotive industry.

Apparatus and methods embodied herein may be employed during at least one of the stages of aircraft manufacturing and service method 100 in FIG. 1. As used herein, the phrase "at least one of", when used with a list of items, means that different combinations of one or more of the listed items may be used and only one of each item in the list may be needed. For example, "at least one of item A, item B, and item C" may include, for example, without limitation, item A or item A and item B. This example also may include item A, item B, and item C or item B and item C.

In one illustrative example, components or subassemblies produced in component and subassembly manufacturing 106 in FIG. 1 may be fabricated or manufactured in a manner similar to components or subassemblies produced while aircraft 200 is in service 112 in FIG. 1. As yet another example, a number of apparatus embodiments, method embodiments, or a combination thereof may be utilized during production stages, such as component and subassembly manufacturing 106 and system integration 108 in FIG. 1. A number, when referring to items, means one or more items. For example, a number of apparatus embodiments is one or more apparatus embodiments.

A number of apparatus embodiments, method embodiments, or a combination thereof may be utilized while aircraft 200 is in service 112 and/or during maintenance and service 114 in FIG. 1. The advantageous embodiments also may be implemented during other stages such as, for example, material procurement 104 and component and subassembly manufacturing 106. The use of a number of the different advantageous embodiments may substantially expedite the assembly of or reduce the cost of aircraft 200.

The different advantageous embodiments recognize and take into account a number of different considerations. For example, the different advantageous embodiments recognize that a lubricant may be added to the surface of the sheet of material in which incremental changes to the shape of the sheet of material may be made.

The different advantageous embodiments, however, recognize and take into account that even though lubricant may be added to the sheet of material, the tip of the stylus may still cause undesirable changes to the sheet of material. These undesirable changes may include, for example, without limitation, galling, ridges, changes in thickness of the sheet of material, changes in surface texture, changes in heat treatment, and other undesirable changes.

Thus, the different advantageous embodiments provide a method and apparatus for incrementally shaping a sheet of material. In one advantageous embodiment, an apparatus comprises a rod having a first end and a second end. A substantially curved surface is present on the first end. Additionally, a texture may be present on at least a portion of the substantially curved surface on the first end. The texture is configured to channel and/or maintain a lubricant on the first end. The second end is configured for attachment to an incremental sheet forming apparatus.

Figure 3:
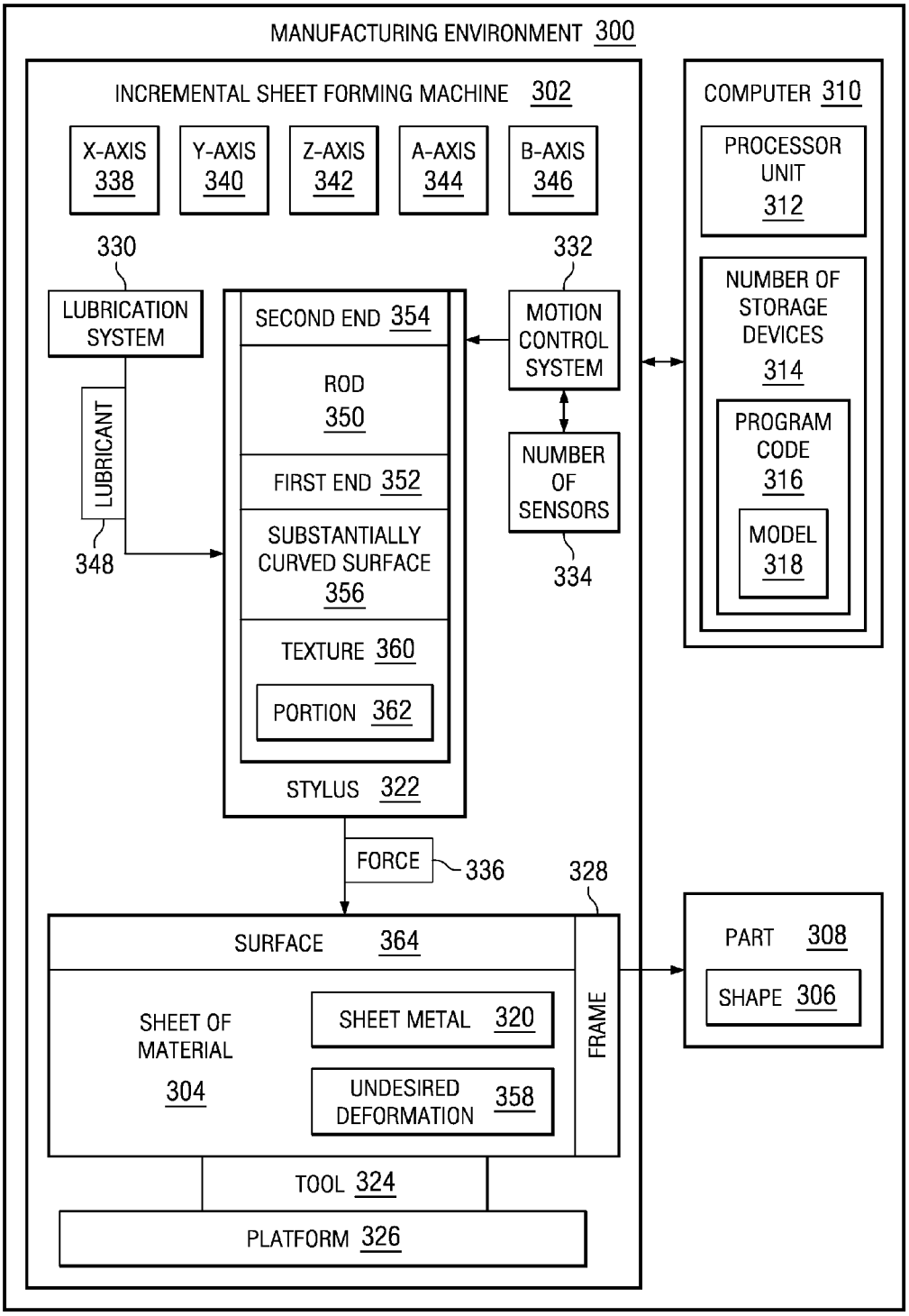
FIG. 3 is an illustration of a manufacturing environment in accordance with an advantageous embodiment.

Turning now to FIG. 3, an illustration of a manufacturing environment is depicted in accordance with an advantageous embodiment. Manufacturing environment 300 may be used to manufacture parts for aircraft 200 in FIG. 2 in these illustrative examples.

Incremental sheet forming machine 302 may incrementally process sheet of material 304 into shape 306 for part 308. Part 308 may be used in aircraft 200 in FIG. 2 in these illustrative examples. Incremental sheet forming machine 302 may incrementally change shape 306 of sheet of material 304. In other words, shape 306 may be formed in multiple steps, rather than in a single step, in these illustrative examples.

This processing of sheet of material 304 may be controlled by computer 310. Computer 310 may have processor unit 312 and number of storage devices 314. Program code 316 may be located on number of storage devices 314. A number, as used herein, when referring to items, means one or more items. For example, number of storage devices 314 is one or more storage devices.

Program code 316 may be located on number of storage devices 314. Number of storage devices 314 may be any storage device capable of storing program code 316 in a functional form for execution by processor unit 312.

Processor unit 312 may be, for example, without limitation, a central processing unit, a multi-core processor, multiple processors, and/or some other suitable processing device or system. Number of storage devices 314 may take various forms. For example, without limitation, number of storage devices 314 may include a random access memory, a read-only memory, a hard disk drive, a solid state disk drive, and/or some other suitable type of storage device.

In these illustrative examples, program code 316 may be executed by processor unit 312 to control incremental sheet forming machine 302 to generate shape 306 for part 308 from sheet of material 304. Shape 306 may be defined using model 318 in these illustrative examples. Model 318 may be a computer-aided design model for part 308.

In these illustrative examples, sheet of material 304 may take various forms. For example, without limitation, sheet of material 304 may take the form of sheet metal 320. Sheet metal 320 may be made from various types of metals. For example, without limitation, sheet metal 320 may be comprised of aluminum, titanium, steel, magnesium, a steel alloy, a nickel alloy, an aluminum alloy, a titanium alloy, and/or any other suitable type of metal. Of course, in other advantageous embodiments, sheet of material 304 may be comprised of other types of materials such as, for example, without limitation, non-metal materials, thermoplastic materials, and/or other suitable types of materials.

Incremental sheet forming machine 302, in these illustrative examples, may include stylus 322, tool 324, platform 326, frame 328, lubrication system 330, motion control system 332, number of sensors 334, and/or any other suitable component.

Stylus 322 may impinge on sheet of material 304 to apply force 336 on sheet of material 304 to create shape 306 from sheet of material 304 to form part 308. In these examples, shape 306 may be incrementally created. In other words, shape 306 may not be formed in a single motion as in die stamping and/or break press machines. Shape 306 may be formed in numerous steps through stylus 322 impinging on sheet of material 304. Tool 324 may be placed on and/or secured to platform 326. Tool 324 may provide an initial shape or place for the shape to be formed. Sheet of material 304 may be held in place on platform 326 using frame 328.

Further, motion control system 332 may move stylus 322 relative to these different components to create shape 306 in sheet of material 304. In the different advantageous embodiments, frame 328 also may move relative to stylus 322.

For example, without limitation, frame 328 may move along X-axis 338 and Y-axis 340, while stylus 322 moves along Z-axis 342. In other advantageous embodiments, platform 326 may move along Z-axis 342. Stylus 322 also may be positioned about A-axis 344 and B-axis 346. In these examples, A-axis 344 may be rotated about X-axis 338, and B-axis 346 may be rotated about Y-axis 340. Of course, other numbers of axes may be used, depending on the particular implementation.

Number of sensors 334 may identify a location of stylus 322. Further, number of sensors 334 also may detect other parameters. For example, number of sensors 334 may detect force, temperature, and/or other parameters that may be sensed during impinging of sheet of material 304 by stylus 322.

In these illustrative examples, lubrication system 330 may supply lubricant 348 to stylus 322, while stylus 322 impinges sheet of material 304. In these illustrative examples, stylus 322 may include rod 350 having first end 352 and second end 354. First end 352 may have substantially curved surface 356. Substantially curved surface 356 may have a number of different shapes. For example, without limitation, substantially curved surface 356 may be a hemisphere, a curve, and/or some other suitable shape.

Substantially curved surface 356 may be selected to reduce undesired deformation 358 of sheet of material 304 during shaping of sheet of material 304 into shape 306 using stylus 322. Additionally, texture 360 may be present on at least portion 362 of substantially curved surface 356 on first end 352. Texture 360 may be configured to channel lubricant 348 onto first end 352. In other words, texture 360 may cause lubricant 348 to coat at least portions of substantially curved surface 356 when substantially curved surface 356 impinges on surface 364 of sheet of material 304.

The illustration of manufacturing environment 300 in FIG. 3 is not meant to imply physical or architectural limitations to the manner in which different advantageous embodiments may be implemented. Other components in addition to and/or in place of the ones illustrated may be used. Some components may be unnecessary in some advantageous embodiments. Also, the blocks are presented to illustrate some functional components. One or more of these blocks may be combined and/or divided into different blocks when implemented in different advantageous embodiments.

For example, in some advantageous embodiments, manufacturing environment 300 may include an additional incremental sheet forming machine in addition to incremental sheet forming machine 302 in FIG. 3. In yet other advantageous embodiments, an additional stylus, in addition to stylus 322, may be controlled and moved to generate shape 306 for part 308. As another example, in some advantageous embodiments, a motion control system may be a separate component from incremental sheet forming machine 302.

Figure 4:
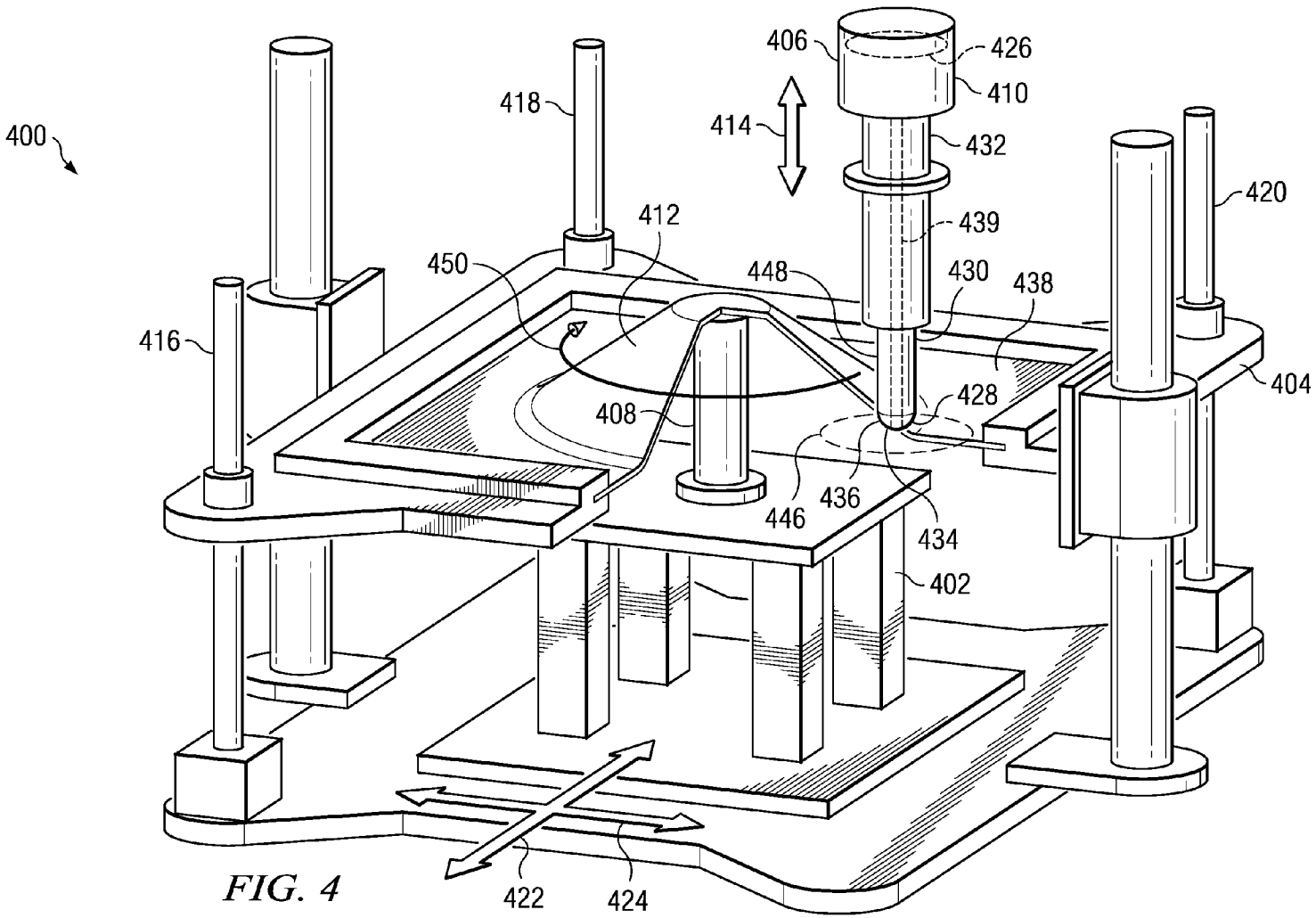
FIG. 4 is an illustration of an incremental sheet forming machine in accordance with an advantageous embodiment.

With reference now to FIG. 4, an illustration of an incremental sheet forming machine is depicted in accordance with an advantageous embodiment. In this illustrative example, incremental sheet forming machine 400 is an example of one implementation for incremental sheet forming machine 302 in FIG. 3.

In this illustrative example, incremental sheet forming machine 400 may include platform 402, frame 404, stylus 406, forming tool 408, and lubrication system 410.

Sheet metal material 412 may be secured to frame 404. Frame 404, in these examples, may take the form of a clamp plate that may be moveable along Z-axis 414. Frame 404 may move along Z-axis 414 along guideposts 416, 418, and 420. Another guidepost may be present but is not shown in this partial cutaway view. Platform 402 may be moveable along X-axis 422 and Y-axis 424 in these illustrative examples. In other advantageous embodiments, frame 404 may be stationary, while platform 402 may be moveable along Z-axis 414.

As depicted, forming tool 408 may be secured to and/or attached to platform 402 in these illustrative examples. In this manner, movement of platform 402 may also cause movement of forming tool 408. Further, forming tool 408 may move along Z-axis 414, while platform 402 may move along X-axis 422 and Y-axis 424. Stylus 406 may move downward to create a shape for sheet metal material 412. Further, in these illustrative examples, frame 404 also may move vertically towards sheet metal material 412 during the forming of the shape for sheet metal material 412.

Stylus 406 in frame 404 may move vertically in small increments. The increment may be, for example, without limitation, from around 0.001 inches to around 0.015 inches. With each vertical increment, platform 402 may move along X-axis 422 and Y-axis 424 to provide features for the shape of sheet metal material 412. This incremental movement may continue until the shape of the part is formed. Although stylus 406 is shown as only moving vertically along Z-axis 414, stylus 406 also may be moved horizontally along X-axis 422 and Y-axis 424.

In this illustrative example, lubrication system 410 is configured to supply lubricant 426 to first end 428 of stylus 406. Second end 430 of stylus 406 may be attached to tool holder 432. In this illustrative example, substantially curved surface 434 on first end 428 may include texture 436. Texture 436 may be configured to channel lubricant 426 onto first end 428 when stylus 406 impinges sheet metal material 412. Additionally, texture 436 may be configured to maintain lubricant 426 on first end 428.

More specifically, texture 436 may be capable of channeling and/or maintaining lubricant 426 onto at least a portion of substantially curved surface 434. Texture 436 may have a number of different forms. For example, without limitation, texture 436 may be selected from at least one of grooves, dimples, pits, holes, and/or other suitable types of textures. In this manner, undesired changes to surface 438 of sheet metal material 412 may be avoided.

In these illustrative examples, lubrication system 410 may supply lubricant 426 in a number of different ways. For example, lubrication system 410 may send lubricant 426 through channel 439 in stylus 406 to substantially curved surface 434. In this example, channel 439 may be in communication with substantially curved surface 434.

In other advantageous embodiments, lubrication system 410 may supply lubricant 426 to location 446 on surface 438 of sheet metal material 412. Location 446 is a location on a surface in which stylus 406 will impinge and/or is impinging. Lubricant 426 may be supplied directly to surface 438 by lubrication system 410 or even along side 448 of stylus 406.

In the different illustrative examples, stylus 406 may be fixed. In other advantageous embodiments, stylus 406 may rotate about Z-axis 414 in the direction of arrow 450.

Figure 5:
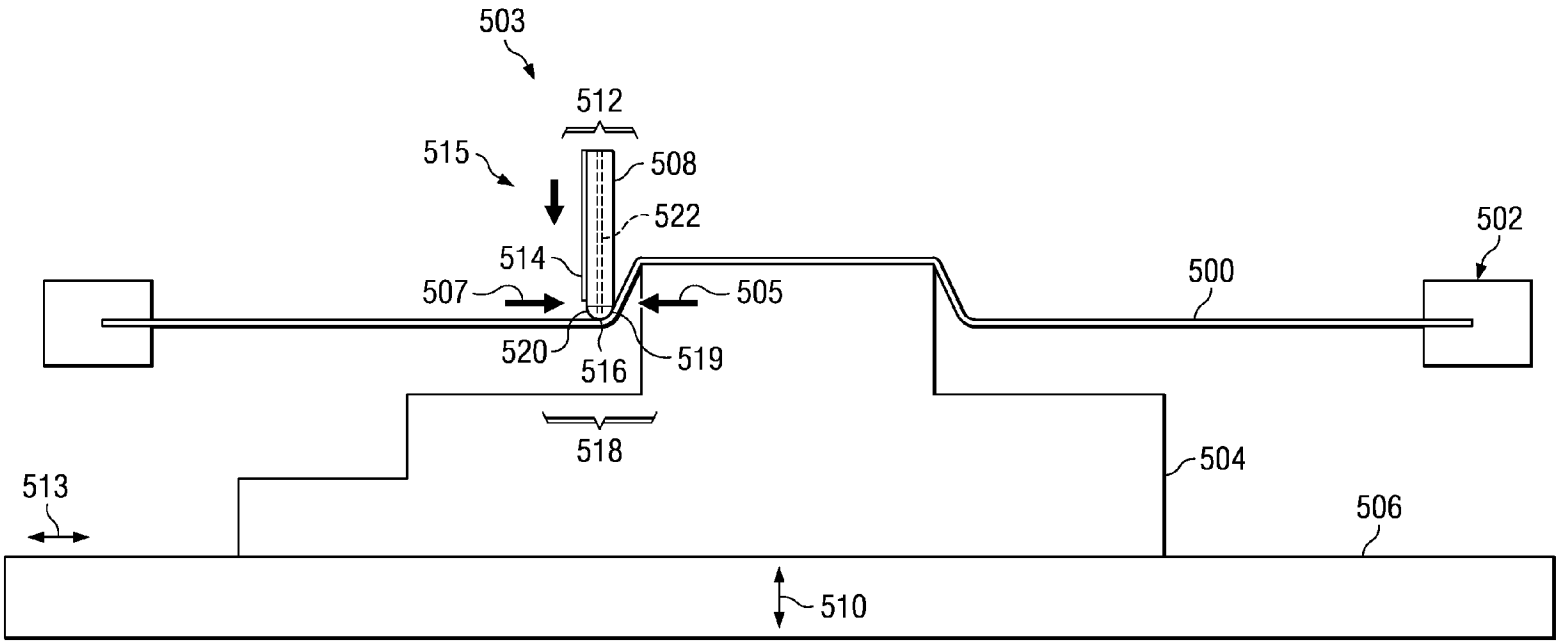
FIG. 5 is an illustration of incremental sheet metal forming in accordance with an advantageous embodiment.
Figure 6:
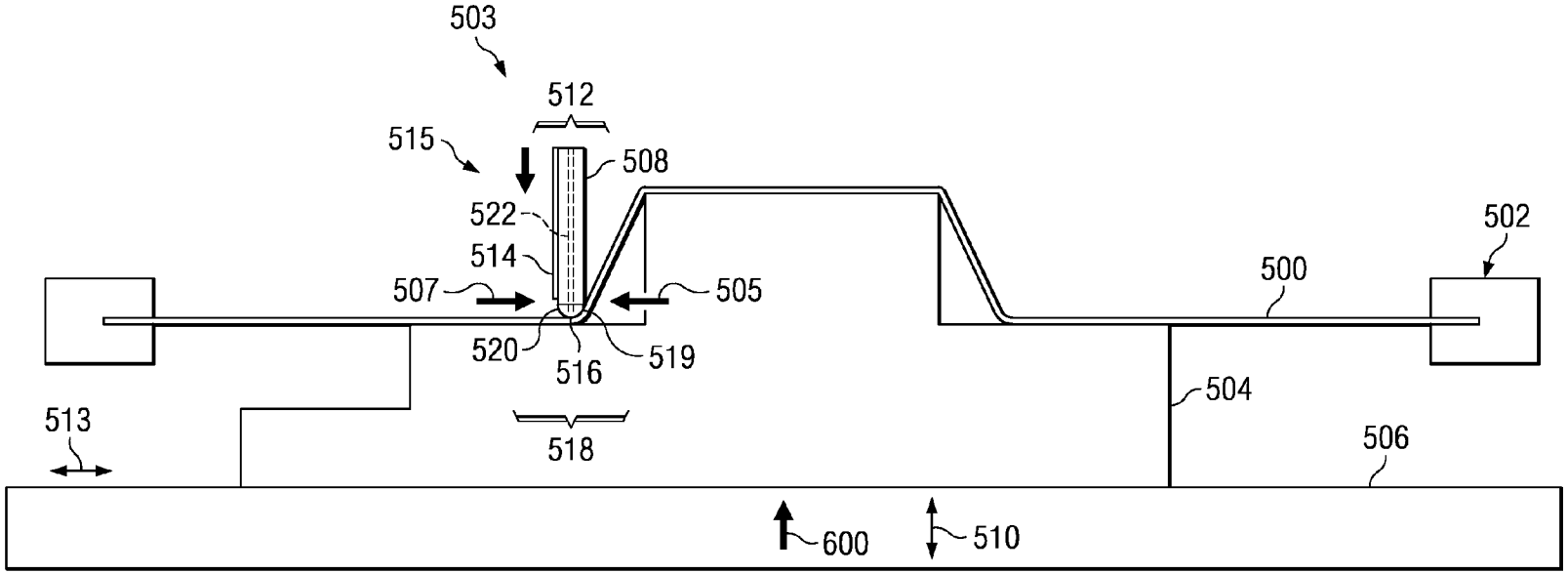
FIG. 6 is an illustration of incremental sheet metal forming in accordance with an advantageous embodiment.
Figure 7:
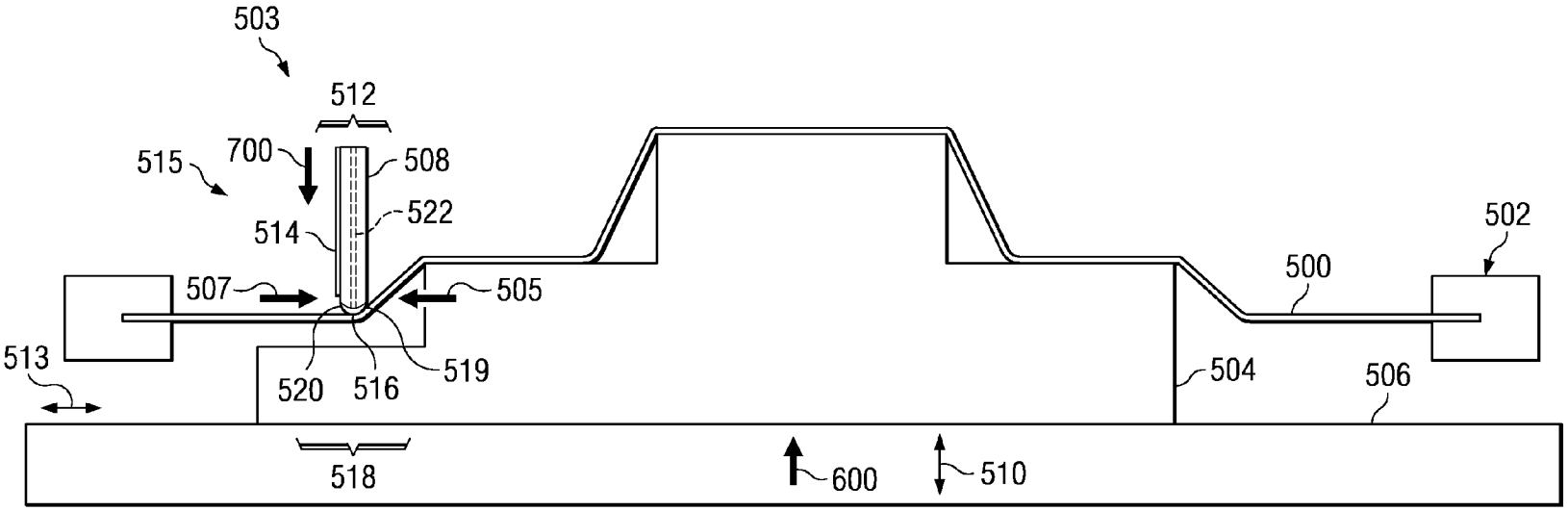
FIG. 7 is an illustration of incremental sheet metal forming in accordance with an advantageous embodiment.

With reference next to FIGS. 5, 6, and 7, illustrations of incremental sheet metal forming are depicted in accordance with an advantageous embodiment. In FIG. 5, sheet metal material 500 may be held in frame 502 in incremental sheet forming machine 503. Tool 504 may sit on platform 506. Stylus 508 may move along Z-axis 510 to shape sheet metal material 500. Stylus 508 may move downward, while platform 506 may move upward when impinging sheet metal material 500.

In this illustrative example, when stylus 508 moves in the direction of arrow 505, force 507 may be generated in the opposite direction of travel. Force 507 may cause undesirable changes to sheet metal material 500 in these examples. These undesirable changes caused by force 507 may be reduced and/or eliminated through the use of stylus 508, which may be implemented using stylus 322 in FIG. 3. For example, during impingement of stylus 508 on sheet metal material 500, lubricating system 512 may deliver lubricant 514 to portion 518 of sheet metal material 500 around stylus 508.

As illustrated, stylus 508 may have texture 516 on substantially curved surface 519 at first end 520. Texture 516 may facilitate channeling lubricant 514 onto curved surface 519 at first end 520 in these illustrative examples. In some advantageous embodiments, lubrication system 512 may send lubricant 514 through stylus 508 to texture 516. In this type of implementation, texture 516 may take the form of holes that may be in communication with channel 522. As discussed above, lubricant 514 may be applied directly to surface 438 or along side 448 of stylus 406 onto texture 436.

In this manner, as stylus 508 moves to impinge on sheet metal material 500, the presence of lubricant 514 on at least a portion of curved surface 519 may reduce undesirable deformations to sheet metal material 500.

Of course, in other advantageous embodiments, platform 506 may move in an X and Y direction with frame 502 moving along Z-axis 510. The types of movements of the different components may vary, depending on the particular implementation. In this example, frame 502 may be stationary, while platform 506 may move along Z-axis 510. Stylus 508 also may move along Z-axis 510, as well as along X-axis 513 and Y-axis (not shown).

In FIG. 6, platform 506 may have moved along Z-axis 510 in an upward motion towards stylus 508 as indicated by arrow 600. In FIG. 7, platform 506 may have moved another distance upward in the direction of arrow 600, while stylus 508 may have moved another distance downward in the direction of arrow 700, as well as along the X and Y axes, to form a shape for sheet metal material 500.

The impingement of stylus 508 on sheet metal material 500 as illustrated in FIGS. 5, 6, and 7 may be performed with reduced amounts of undesirable changes to sheet metal material 500. In these different advantageous embodiments, texture 516 on at least a portion of curved surface 519 may allow for lubricant 514 to reduce undesired changes. Also in these examples, stylus 508 may remain stationary with platform 506 moving. In other examples, stylus 508 may move, while platform 506 is stationary, or both stylus 508 and platform 506 may move.

The illustration of incremental sheet forming machine 503 in FIGS. 5, 6, and 7 is for purposes of illustrating one manner in which incremental sheet forming machine 302 in FIG. 3 can be implemented. Other advantageous embodiments may be implemented differently. For example, without limitation, other incremental sheet forming machines may have other numbers of lubrication systems or other mechanisms to move lubricant 514. For example, lubrication system 512 may be located on a separate device from stylus 508. For example, lubrication system 512 may be moved using a robotic arm.

Figure 8:
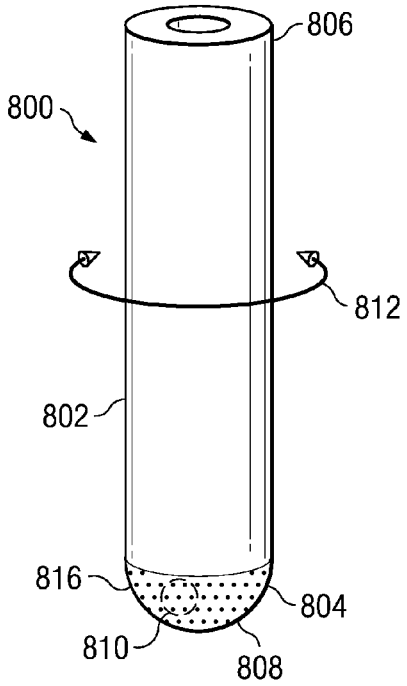
FIG. 8 is an illustration of a stylus in accordance with an advantageous embodiment.

Turning now to FIG. 8, an illustration of a stylus is depicted in accordance with an advantageous embodiment. In this illustrative example, stylus 800 is an example of one implementation of stylus 322 in FIG. 3. In this illustrative example, stylus 800 may comprise rod 802 with first end 804 and second end 806. Substantially curved surface 808 may be present at first end 804. Additionally, texture 810 may be present on at least a portion of substantially curved surface 808. In this illustrative example, substantially curved surface 808 may be substantially spherical. Texture 810 may include dimples in this illustration. Stylus 800 may be stationary or may rotate in the direction of arrow 812.

Figure 9:
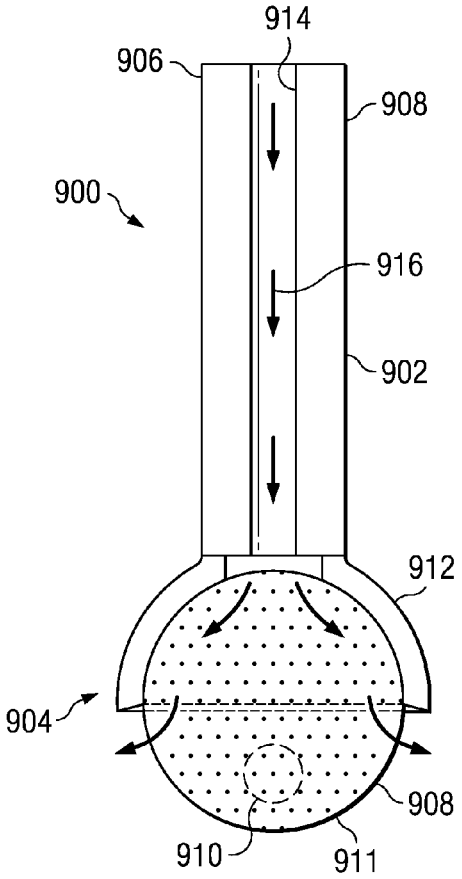
FIG. 9 is an illustration of a stylus in accordance with an advantageous embodiment.

Turning now to FIG. 9, an illustration of a stylus is depicted in accordance with an advantageous embodiment. In this illustrative example, stylus 900 is an example of one implementation of stylus 322 in FIG. 3.

As illustrated, stylus 900 may comprise rod 902 having first end 904 and second end 906. In this illustrative example, first end 904 may have substantially curved surface 908. Texture 910 is present on at least a portion of substantially curved surface 908. In this illustrative example, curved surface 908 may take the form of sphere 911, which may be associated with cradle 912 in rod 902.

In this illustrative example, sphere 911 may be rotatably held by cradle 912. Further, rod 902 may have channel 914 through which lubricant 916 may be supplied to sphere 911. In these illustrative examples, sphere 911 may rotate in any number of axes during use.

Figure 10:
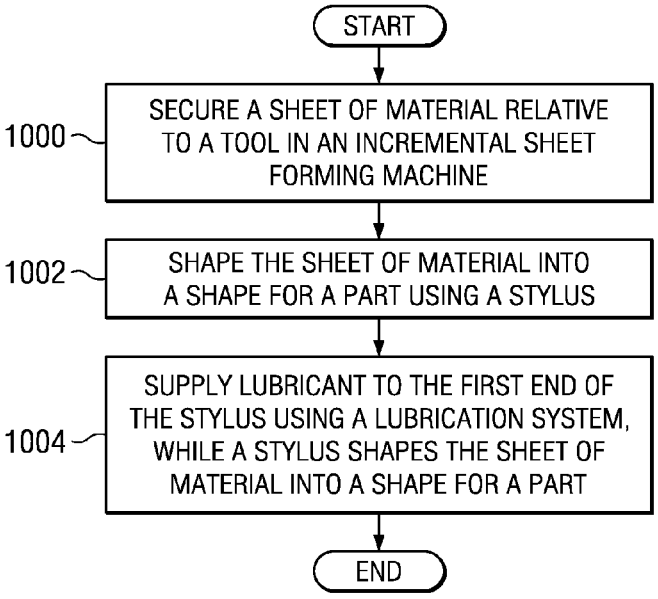
FIG. 10 is an illustration of a flowchart of a process for processing a sheet of material in accordance with an advantageous embodiment.

Turning now to FIG. 10, an illustration of a flowchart of a process for processing a sheet of material is depicted in accordance with an advantageous embodiment. The process illustrated in FIG. 10 may be implemented using manufacturing environment 300 in FIG. 3. More specifically, the process may be implemented using incremental sheet forming machine 302 in FIG. 3 to form sheet of material 304 into shape 306 for part 308.

The process may begin by securing sheet of material 304 relative to tool 324 in incremental sheet forming machine 302 (operation 1000). In these illustrative examples, sheet of material 304 may be secured relative to tool 324 in a number of different ways. For example, sheet of material 304 may be secured above tool 324, below tool 324, or beside tool 324, depending on the particular implementation. Tool 324 may have a rough shape used to shape sheet of material 304 into shape 306.

Sheet of material 304 may be shaped into shape 306 for part 308 using stylus 322 in combination with tool 324 (operation 1002). In these illustrative examples, stylus 322 may include rod 350 having first end 352 and second end 354. First end 352 may have substantially curved surface 356. Substantially curved surface 356 may include texture 360 on at least portion 362 of substantially curved surface 356 on first end 352. Texture 360 may be configured to channel lubricant 348 onto first end 352. Further, texture 360 also may be configured to maintain lubricant 348 on first end 352. The process may supply lubricant 348 to first end 352 using lubrication system 330, while stylus 322 shapes sheet of material 304 into shape 306 for part 308 (operation 1004), with the process terminating thereafter.

The flowcharts and block diagrams in the different depicted embodiments illustrate the architecture, functionality, and operation of some possible implementations of apparatus and methods in different advantageous embodiments. In this regard, each block in the flowchart or block diagrams may represent a module, segment, function, and/or a portion of an operation or step. In some alternative implementations, the function or functions noted in the blocks may occur out of the order noted in the figures. For example, in some cases, two blocks shown in succession may be executed substantially concurrently, or the blocks may sometimes be executed in the reverse order, depending upon the functionality involved.

For example, operation 1002 and operation 1004 may be performed simultaneously. In some advantageous embodiments, lubrication may be applied at the same time as the stylus impinges the sheet of material. In yet other advantageous embodiments, lubrication may be applied, and then the sheet of material may be impinged.

Thus, the different advantageous embodiments provide a method and apparatus for forming a part using an incremental sheet forming machine to generate the shape of the part. In one or more of the different advantageous embodiments, the end of the stylus that contacts the surface of the sheet of material may have a texture capable of channeling or allowing lubricant to be present at the first end.

Further, the different advantageous embodiments may reduce the metal-to-metal contact between the stylus and the sheet of material through the presence of the lubricant. In this manner, the lubricant may be substantially maintained between the stylus and the sheet of material being formed. The texture may prevent lubricant from being pressed away from the location where the stylus impinges on the sheet of material in these illustrative examples. In this manner, undesirable changes to the sheet of material and wearing of the impingement surface of the tool may be reduced and/or avoided.

Also, the texture may reduce the contact area between the stylus and the sheet of material. The reduction in the contact area may reduce friction. At least some of these and other features in the advantageous embodiments may reduce and/or avoid undesired changes to a sheet of material during impingement.

The description of the different advantageous embodiments has been presented for purposes of illustration and description, and it is not intended to be exhaustive or limited to the embodiments in the form disclosed. Many modifications and variations will be apparent to those of ordinary skill in the art. Further, different advantageous embodiments may provide different advantages as compared to other advantageous embodiments.

The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An incremental sheet forming apparatus comprising:

a rod having a first end and a second end;

a substantially curved surface on the first end in which the first end is configured to impinge a sheet of material to form a shape for a part; and a texture on at least a portion of the substantially curved surface on the first end, wherein the texture is configured to channel a lubricant onto the sheet of material;

a platform configured to hold the sheet of material;

a motion control system configured to control movement of the substantially curved surface to impinge the sheet of material to form the part;

a lubrication system configured to supply the lubricant along an outer surface of the rod to the substantially curved surface while the substantially curved surface impinges the sheet of material; and wherein the lubricant on the substantially curved surface reduces undesired deformation of the sheet of material while the substantially curved surface impinges the sheet of material.

2. The incremental sheet forming apparatus of claim 1, wherein the lubrication system comprises a storage tank configured to supply directly the lubricant along the outer surface of the rod to the substantially curved surface.

3. The incremental sheet forming apparatus of claim 2 further comprising:

a number of sensors that identify a location of the rod and detect a force and a temperature sensed during impingement of the sheet of material by the substantially curved surface.

4. The incremental sheet forming apparatus of claim 2, wherein the texture comprises one of grooves, dimples, pits, and holes.

5. The incremental sheet forming apparatus of claim 2, wherein the storage tank is configured to be placed on top of the rod.

6. An incremental sheet forming apparatus for forming aircraft parts comprising:

a stylus comprising a rod having a first end and a second end, a cradle associated with the first end, a ball associated with the cradle, a substantially curved surface on the ball, texture on at least a portion of the substantially curved surface on the first end, and a channel extending through the rod and the cradle to the ball, wherein the channel is configured to cause a lubricant to flow through the rod and the cradle and onto the substantially curved surface on the ball;

a platform configured to hold a sheet metal material;

a motion control system configured to control movement of the stylus to impinge the sheet metal material to form an aircraft part; and a lubrication system configured to supply the lubricant to the ball while the ball impinges the sheet metal material through the channel in the rod and in which the lubrication on the substantially curved surface reduces undesired deformation of the sheet metal material while the stylus impinges the sheet metal material;

wherein the cradle has a first outside diameter and the rod has a second outside diameter and the first outside diameter is greater than the first outside diameter; and wherein the cradle surrounds and continuously contacts an approximate half of an outer spherical surface of the ball except for a region of the approximate half of the outer spherical surface of the ball where the cradle surrounds the channel.

7. The incremental sheet forming apparatus for forming aircraft parts of claim 6, wherein the lubrication system comprises a storage tank configured to supply directly the lubricant to the ball through the channel in the rod.

8. The incremental sheet forming apparatus for forming aircraft parts of claim 7, further comprising:

a number of sensors that identify a location of the stylus and detect a force and a temperature sensed during impingement of the sheet metal material by the stylus.

9. The incremental sheet forming apparatus for forming aircraft parts of claim 7, wherein the texture comprises one of grooves, dimples, pits, and holes.

10. The incremental sheet forming apparatus for forming aircraft parts of claim 7, wherein the storage tank is configured to be placed on top of the stylus.

11. A method for processing a sheet of material, the method comprising:

securing the sheet of material relative to a tool in an incremental sheet metal forming machine;

incrementally shaping the sheet of material into a shape of a part using a stylus in which the stylus comprises a rod having a first end and a second end, a ball rotatably engaged in the first end, and a texture on at least a portion of the ball; and supplying a lubricant to the ball by supplying the lubricant along an outer surface of the stylus to the ball while the ball impinges the sheet of material.

12. The method for processing a sheet of material of claim 11, wherein the supplying the lubricant to the ball comprises supplying directly from a storage tank the lubricant along the outer surface of the stylus to the ball.

13. The method for processing a sheet of material of claim 12, the method further comprising:

identifying a location of the stylus and detecting a force and a temperature during impingement of the sheet of material by the stylus, wherein the location, the force, and the temperature are sensed by a number of sensors.

14. The method for processing a sheet of material of claim 12, wherein the texture comprises one of grooves, dimples, pits, and holes.

15. The method for processing a sheet of material of claim 12, wherein the storage tank is configured to be placed on top of the stylus.

16. A method for manufacturing a part for an aircraft, the method comprising:

securing a sheet metal material relative to a tool in an incremental sheet metal forming machine; and incrementally shaping the sheet metal material into a shape of the part by impinging the sheet metal material with a stylus in which the stylus comprises a rod having a first end and a second end; a substantially curved surface on the first end; a number of holes in at least a portion of the substantially curved surface on the first end, and a channel extending through the rod to the first end, in which the channel is configured to cause a lubricant to flow directly from a storage tank through the rod and through the number of holes onto the sheet metal material to maintain the lubricant on the sheet metal material; and wherein the rod and the substantially curved surface form the stylus in one piece.

17. The method for manufacturing a part for an aircraft of claim 16, the method comprising:

identifying a location of the stylus and detecting a force and a temperature during impingement of the sheet metal material by the stylus, wherein the location, the force, and the temperature are sensed by a number of sensors.

18. The method for manufacturing the part for the aircraft of claim 16, wherein the storage tank is configured to be placed on top of the stylus.

19. The method for manufacturing the part for the aircraft of claim 16, wherein the number of holes prevent the lubricant from being pressed away from a location where the stylus impinges on the sheet metal material.

* * * * *